US008756888B2

(12) United States Patent
Bowron

(10) Patent No.: US 8,756,888 B2
(45) Date of Patent: Jun. 24, 2014

(54) MODULAR BUILDING PANEL AND DUCT SYSTEM

(75) Inventor: Julian Bowron, Toronto (CA)

(73) Assignee: Feature Walters, Toronto, Ontario (CA)

( * ) Notice: Subject to any disclaimer, the term of this patent is extended or adjusted under 35 U.S.C. 154(b) by 219 days.

(21) Appl. No.: 13/108,605

(22) Filed: May 16, 2011

(65) Prior Publication Data

US 2011/0277405 A1 Nov. 17, 2011

Related U.S. Application Data

(60) Provisional application No. 61/345,290, filed on May 17, 2010, provisional application No. 61/334,751, filed on May 14, 2010.

(51) Int. Cl.

| | |
|---|---|
| ***E04B 1/70*** | (2006.01) |
| ***F24F 7/00*** | (2006.01) |
| ***F24F 13/00*** | (2006.01) |

(52) U.S. Cl.

USPC ..... 52/302.3; 454/243; 454/271

(58) Field of Classification Search

USPC ..... 52/95, 198, 199, 302.1, 302.3, 302.4, 52/302.6; 454/185, 237, 241, 243, 247, 454/248, 260, 270, 271

See application file for complete search history.

(56) References Cited

U.S. PATENT DOCUMENTS

| | | | | |
|---|---|---|---|---|
| 1,686,118 | A * | 10/1928 | Barrie | 52/302.3 |
| 2,975,559 | A * | 3/1961 | William | 52/98 |
| 3,326,112 | A * | 6/1967 | Sadlow et al. | 454/248 |
| 3,353,472 | A * | 11/1967 | Lee | 454/237 |
| 3,366,364 | A * | 1/1968 | Curran | 251/85 |
| 3,368,473 | A * | 2/1968 | Yoshitoshi et al. | 454/185 |
| 3,905,171 | A * | 9/1975 | Cargill et al. | 52/783.18 |
| 4,000,594 | A | 1/1977 | Kirk, Jr. | |
| 5,899,031 | A * | 5/1999 | Nagaoka et al. | 52/169.5 |
| 6,357,185 | B1 * | 3/2002 | Obermeyer et al. | 52/95 |
| 7,818,922 | B2 * | 10/2010 | Ellis | 52/95 |
| 8,028,483 | B2 * | 10/2011 | Carolan | 52/404.1 |
| 8,152,608 | B1 * | 4/2012 | Hamby | 454/251 |
| 2006/0191232 | A1 | 8/2006 | Salazar et al. | |
| 2007/0094967 | A1 * | 5/2007 | Kosny et al. | 52/309.9 |
| 2010/0229472 | A1 * | 9/2010 | Malpas | 52/79.1 |
| 2011/0173909 | A1 * | 7/2011 | Viau et al. | 52/302.1 |

FOREIGN PATENT DOCUMENTS

| | | |
|---|---|---|
| NL | WO98/13560 | 4/1998 |

OTHER PUBLICATIONS

Canadian Office Action dated Sep. 13, 2011, for Canadian Application No. 2,740,168 filed May 16, 2011.

* cited by examiner

*Primary Examiner* — Ryan Kwiecinski
(74) *Attorney, Agent, or Firm* — Alston & Bird LLP

(57) ABSTRACT

A modular building panel and integrated duct system including at least one modular building panel. The modular building panel includes a panel frame defining a longitudinal, a transverse width, and a transverse height; first and second ducts including therein duct stiffeners being truss or zig-zag shaped; and a ribbed joist spanning between the first duct to the second duct along the transverse width. The modular building panel may be connected to a like modular building panel.

15 Claims, 14 Drawing Sheets

MODULAR BUILDING PANEL AND DUCT SYSTEM

CROSS-REFERENCE TO RELATED APPLICATIONS

This application claims priority to U.S. Provisional Application No. 61/345,290, filed May 17, 2010, entitled Modular Building Panel and Duct System, and U.S. Provisional Application No. 61/334,751, filed May 14, 2010, entitled Modular Building Panel and Duct System, all which are hereby incorporated herein in their entirety by reference.

TECHNOLOGICAL FIELD

Example embodiments generally relate to a methods and systems for fabricating building structures using modular components.

BACKGROUND

Prefabricating building elements such as a panel structures have been used for construction of floor, wall, or overhead structure (ceiling) of a building.

For building systems assembled from individual panel structures, the ceiling or wall is typically first assembled, followed by installation of a separate duct system. Such building assembly systems may result in increased construction times, unnecessary bulk arising from separate components which can result in smaller room depth or height. It is generally undesirable to have thick walls or ceilings so as to interfere with useable space. Similarly, a stand-alone duct system typically cannot in itself provide the necessary support of a ceiling or wall.

There are some roofing panel systems which include a multiple truss structure therein for both support and ventilation. The shape, occurrence and frequency of the multiple truss structures may impede circulation and airflow. Further, such panel systems are typically restricted in that a panel may be able to be used for outflow, but the same panel may not be able to simultaneously perform both inflow and outflow effectively. An example of such a system is illustrated in U.S. Pat. No. 3,368,473 to Yoshitoshi Sohda et al.

Other difficulties with existing systems may be appreciated in view of the detailed description hereinbelow.

BRIEF SUMMARY

According to an example embodiment, there is provided a modular building panel, which includes: a panel frame defining a longitudinal, a transverse width, and a transverse height; a first duct at least partly defined by the panel frame and defining a first passage extending along the longitudinal of the panel frame and positioned along the transverse width; a first duct stiffener contained within the first duct for providing structural support, the first duct stiffener being truss or zig-zag shaped and extending along the transverse width and the transverse height; a second duct at least partly defined by the panel frame and defining a second passage extending along the longitudinal of the panel frame and positioned along the transverse width separate from the first duct; a second duct stiffener contained within the second duct for providing structural support, the second duct stiffener being truss or zig-zag shaped and extending along the transverse width and the transverse height; and a wall of the first duct and the second duct comprising a ribbed joist spanning between the first duct and the second duct along the transverse width.

In accordance with another example embodiment, there is provided a method of reinforcing a duct for use as part of a building panel, the building panel including a panel frame defining a longitudinal, a transverse width, and a transverse height, the duct being at least partly defined by the panel frame and defining a first passage extending along the longitudinal of the panel frame. The method includes positioning a duct stiffener within the duct, the duct stiffener being truss or zig-zag shaped and extending along the transverse width and the transverse height, and extending a ribbed joist from the duct to redistribute loads from the duct, wherein the ribbed joist spans an end-to-end of the transverse width of the panel frame.

In accordance with yet another example embodiment, there is provided a modular building panel and integrated duct system, comprising: a plurality of like modular building panels. Each panel includes a panel frame defining a longitudinal, a transverse width, and a transverse height, a first duct at least partly defined by the panel frame and defining a first passage extending along the longitudinal of the panel frame and positioned along the transverse width, a first duct stiffener contained within the first duct for providing structural support, the first duct stiffener being truss or zig-zag shaped and extending along the transverse width and the transverse height, a second duct at least partly defined by the panel frame and defining a second passage extending along the longitudinal of the panel frame and positioned along the transverse width separate from the first duct, a second duct stiffener contained within the second duct for providing structural support, the second duct stiffener being truss or zig-zag shaped and extending along the transverse width and the transverse height, and a ribbed joist spanning between the first duct to the second duct along the transverse width.

BRIEF DESCRIPTION OF THE DRAWINGS

Embodiments will now be described by way of example with reference to the accompanying drawings, in which like reference numerals are used to indicate similar features, and in which.

DETAILED DESCRIPTION OF VARIOUS EMBODIMENTS

Figure 1:
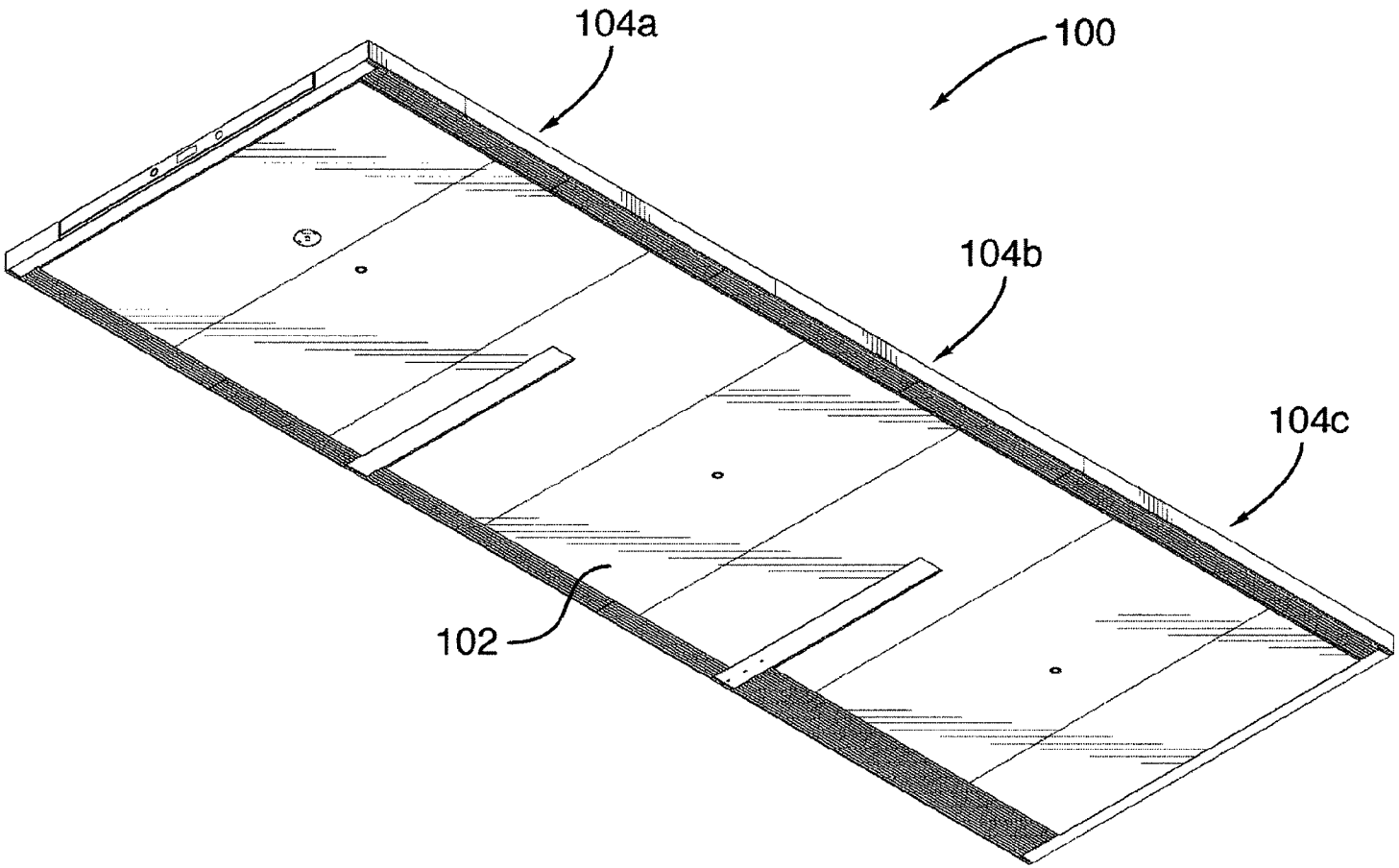
FIG. 1 shows a perspective underside view of a modular building panel and duct system in accordance with an example embodiment.
Figure 2:
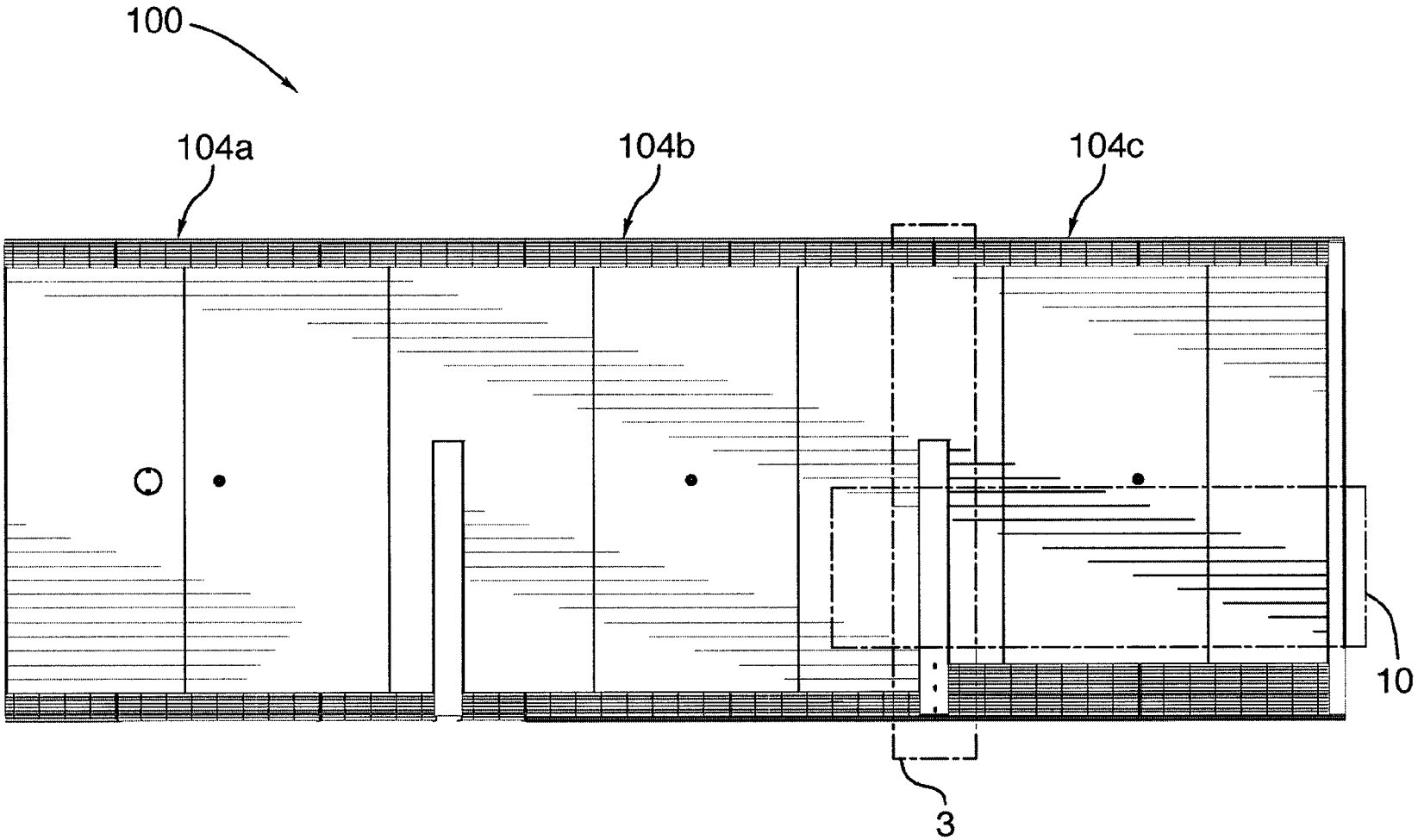
FIG. 2 shows top underside view of the system of FIG. 1.
Figure 3:
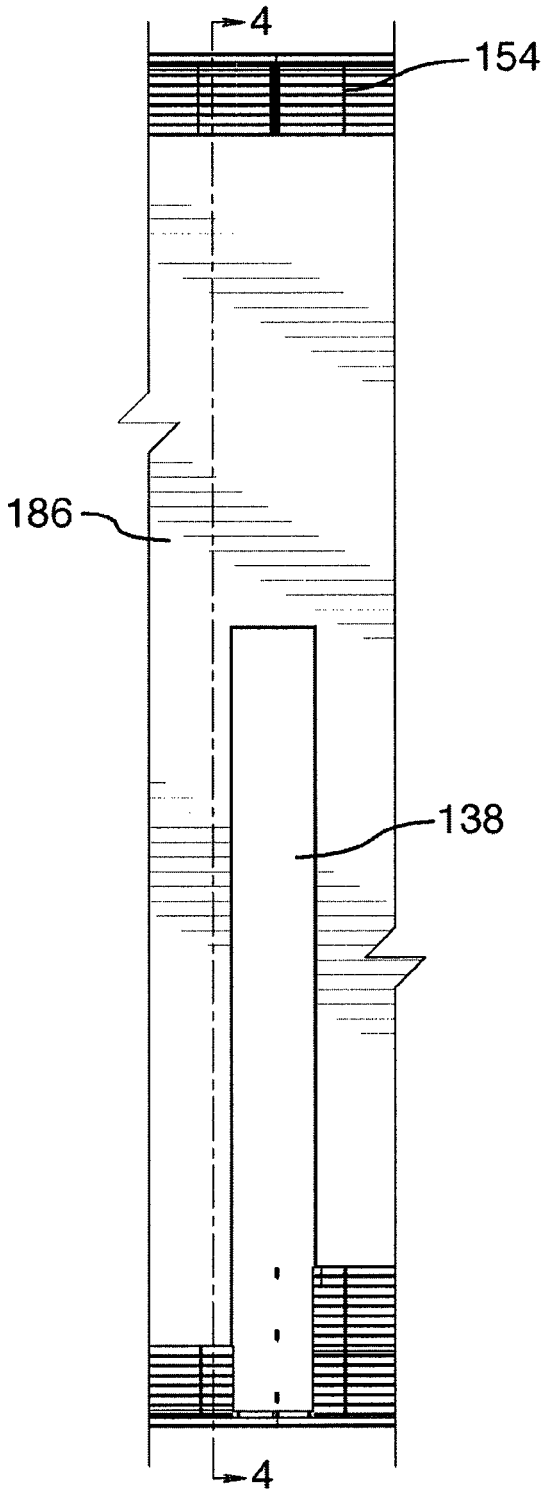
FIG. 3 shows a top detail taken from Detail 3 of FIG. 2.
Figure 4:
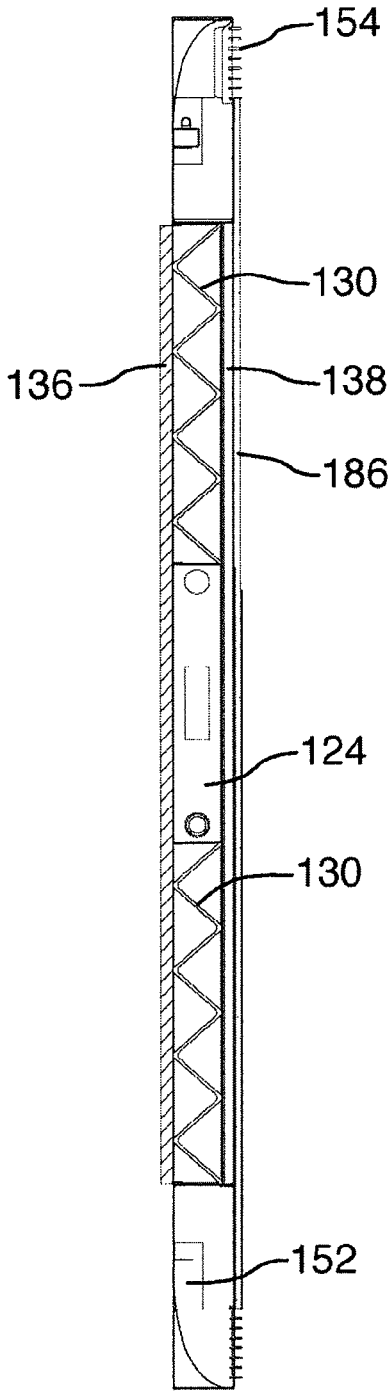
FIG. 4 shows a section view taken along section 4-4 of FIG. 3.

The present invention comprises a system of ducts, and voids, and may include light coves, that can convey and control the distribution of air, lighting and services, and which carries loads applied perpendicularly to the panel face to periodic ribs in the same plane. The load can be generated by gravity acting on the ceiling, or the load of structures above, depending on the orientation of the panel. The invention comprises periodic multi-component rib assemblies that can be disposed at right angles to the first group of parts, some of which pass through the ducts and coves in the same plane to convey the loads to the edges of the panel and thence to adjacent walls/floors. The strong verticals are composed of several different elements joined end to end.

There is a system of parts which unites the first and second groups of components and the subassemblies formed thereof and which provides a surface to which can be attached finishes such as gypsum wall board. Rigidity can be re-distributed from the strong verticals to shallower members by the ducts.

The parts described herein are assembled in subassemblies. The sub-assemblies can be assembled in to larger panels of the desired size owing to interlocking features, thus reducing design and fabrication costs. The frequency of the rib assembly components is lower than the standard frequency of wall or ceiling studs owing to the transverse load carrying capacity of the first group of parts, thus reducing the total number of parts and the degree of obstruction of the ducts. The system facilitates ducts which are/can be plena, allowing for greater freedom of diffuser/register placement than ducts which must fit the standard frequency of strong vertical/horizontals (commonly referred to as studs/joists). The ducts are structural, thus eliminating redundant material and reducing costs and thickness.

A panel made from these two sets of parts comprises a thin, light, exterior or interior grade, self-supporting unitized structural panel which can be used for making exterior roofs, exterior or interior walls and ceilings, which can be hoisted and placed on a pre-fabricated building module, to which can be added insulation, lighting, drywall, sprinklers, smoke detectors, loudspeakers etc. as required.

Because modular building units must be introduced in to building openings and moved across floors to reach their destination, thinness of the ceiling is valuable, as it allows a complete modular building unit to be shipped and placed, without reducing interior ceiling height or requiring excessive overhead clearance. This is an advantage in modules for high-rise offices, condominiums or hotels where increased floor-to-floor height adds to overall building height and cost.

Due to the high rigidity of panels they can be drywalled, seamed and painted, wired, handled and rotated in one piece. The invention provides a duct with a large uninterrupted cross section suitable for conveying low-velocity forced air as commonly used in a commercial building. The invention can provide a full length supply and full length return, with the inlets/outlets being combined with hidden lighting accessible for maintenance, light diffusers which control the beam spread so as to direct lighting on to the walls and light the room per recent architectural fashion.

The ducts comprise plena so air can be introduced and released at any point, reducing design costs and facilitating fine-tuning of airflow. Airflow can be tuned by selectively creating or covering openings, or by the addition of adjustable diffusers or registers. Ducts within panels can be equipped with removable ends disposed so as to be exposed, facilitating cleaning by the introduction of a telescopic brush or vacuum nozzle.

Example embodiments generally relate to a modular building panel and duct system, which is constructed from like modular building panels. The system may be used to construct sidewalls, ceilings, and floors (typically the floor is formed from the ceiling of the story below). The system provides a modular, structural building panel and duct system with integrated ventilation ducts incorporating a means to circulate and install building services such as plumbing, sprinklers, alarms, electrical, speakers, phone and data lines, and lighting within the assembled wall. The modular building panel itself acts as a duct or ventilation system.

Reference is first made to FIGS. 1 to 4 and 10 to 12, which show a modular building panel and duct system 100 in accordance with an example embodiment. An underside 102 of the system 100 is shown as aspects the system 100 may be constructed or assembled upside-down when used for a ceiling configuration. As shown in FIG. 1, the system 100 includes a plurality of like modular building panels 104*a*, 104*b*, and 104*c* (each or collectively referenced as 104). Generally, each modular building panel 104 is of like construction and may be attached to a like modular building panel 104. Generally, the modular building panel 104 includes reinforced integrated ventilation ducts and joists which redistribute load from the ducts to other structures, as described in greater detail herein.

Figure 5A:
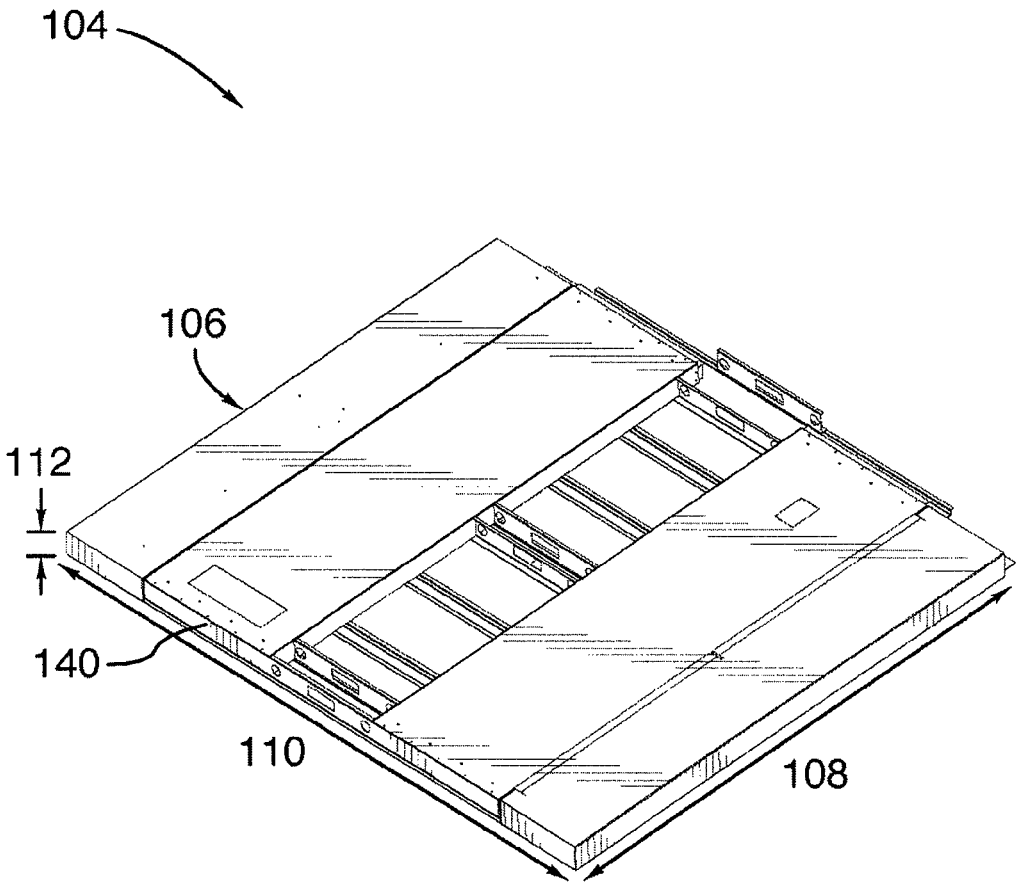
FIG. 5A shows a perspective view of a modular building panel to be used in the system of FIG. 1.
Figure 5B:
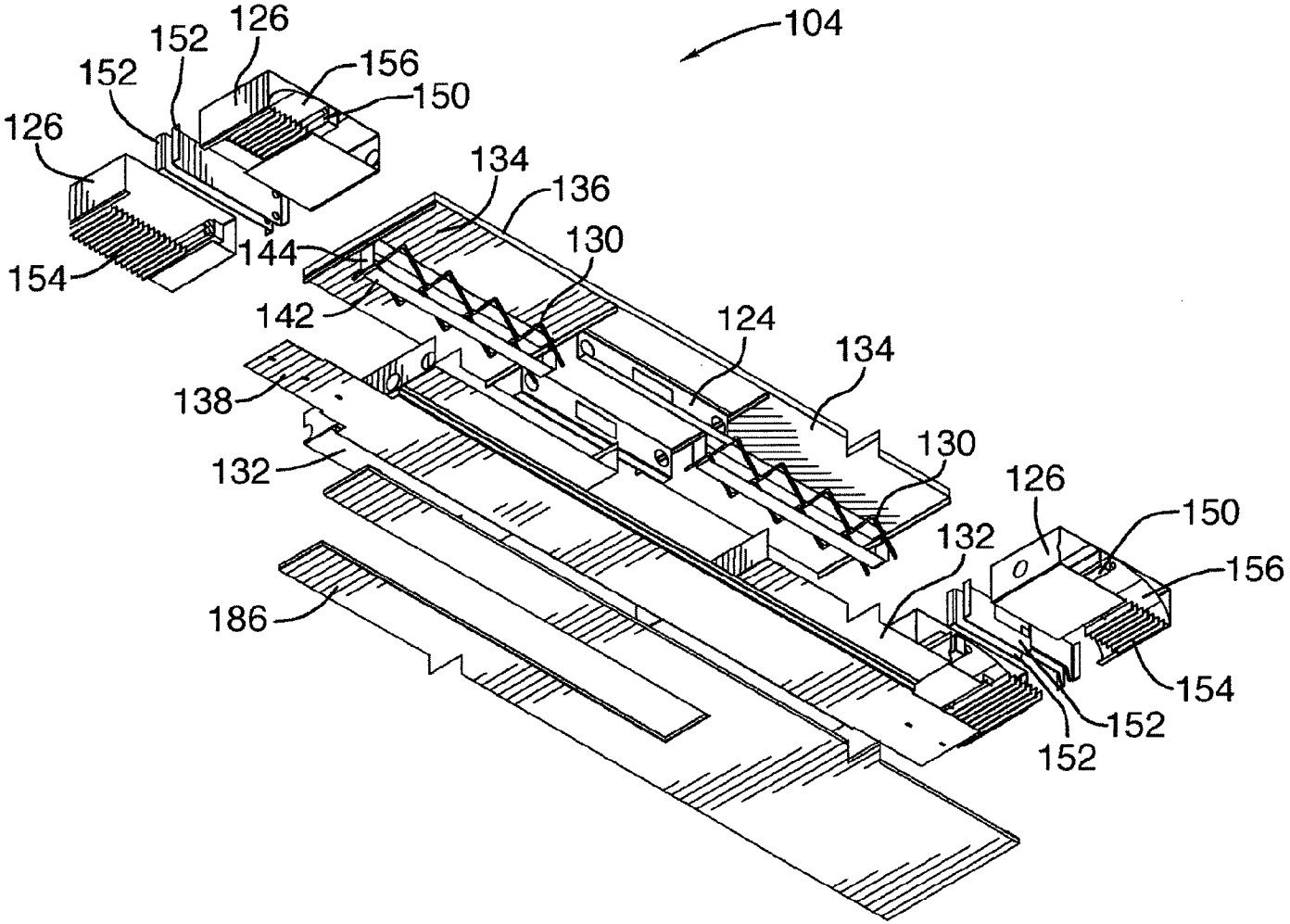
FIG. 5B shows an exploded perspective view of the modular building panel of FIG. 5A.
Figure 6:
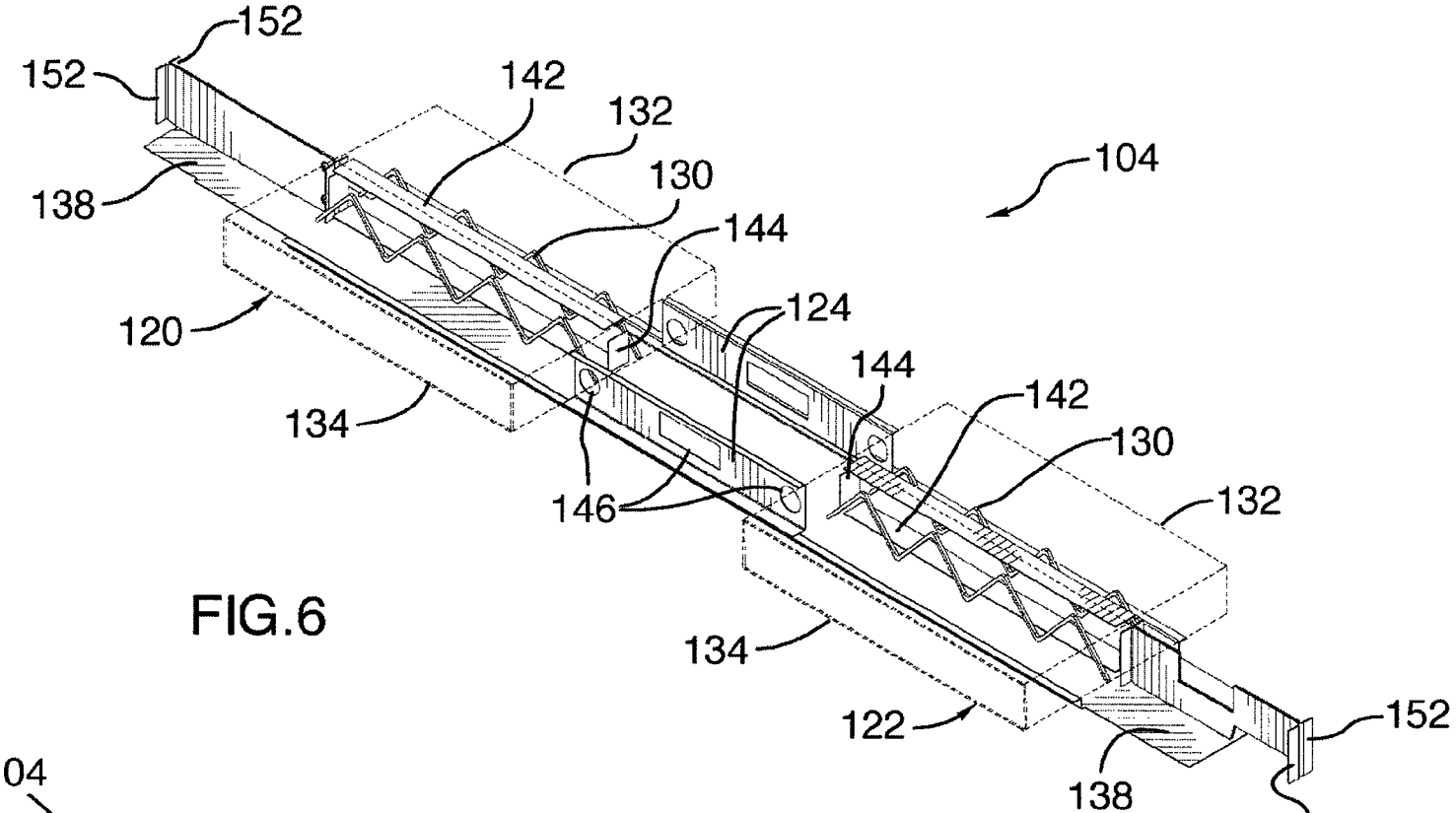
FIG. 6 shows a cutaway perspective view of the modular building panel of FIG. 5B.
Figure 7:
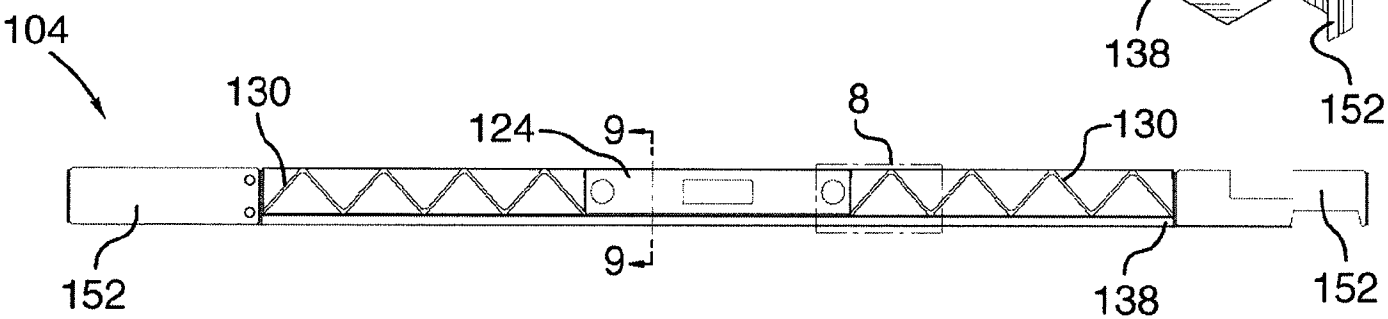
FIG. 7 shows a front side view of the modular building panel of FIG. 6.
Figure 8:
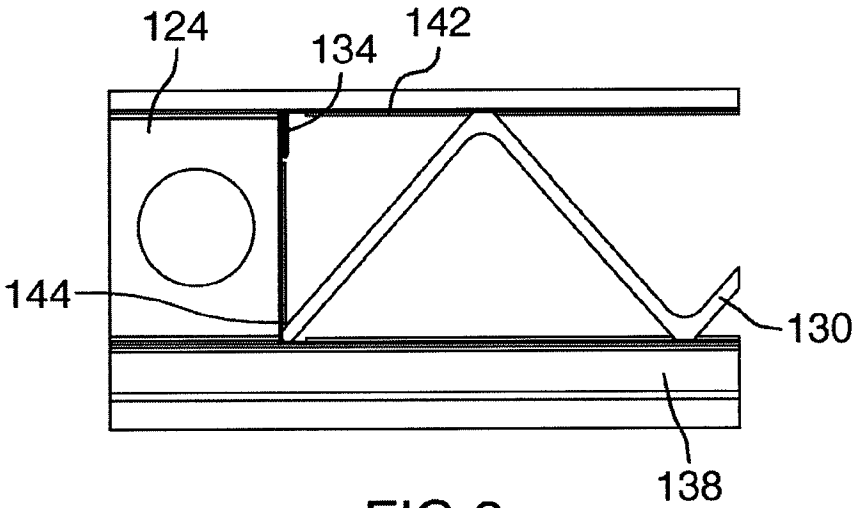
FIG. 8 shows a front side detail taken from Detail 8 of FIG. 7.
Figure 9:
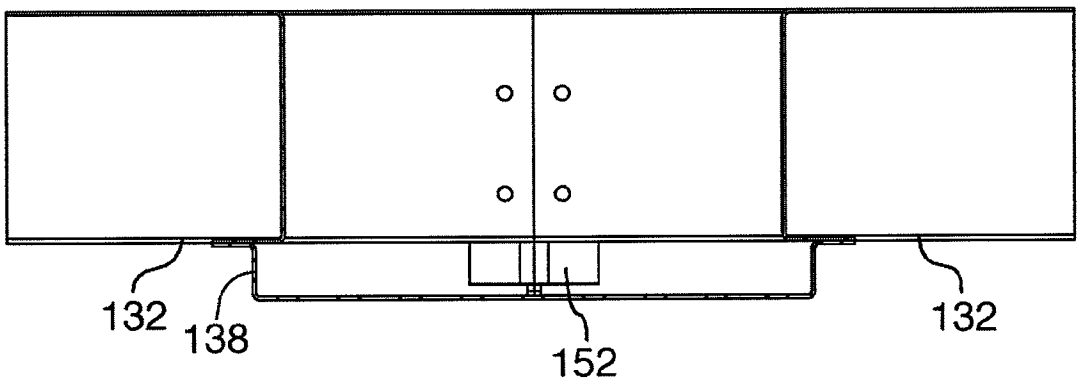
FIG. 9 shows a section view taken along section 9-9 of FIG. 7.
Figure 10:
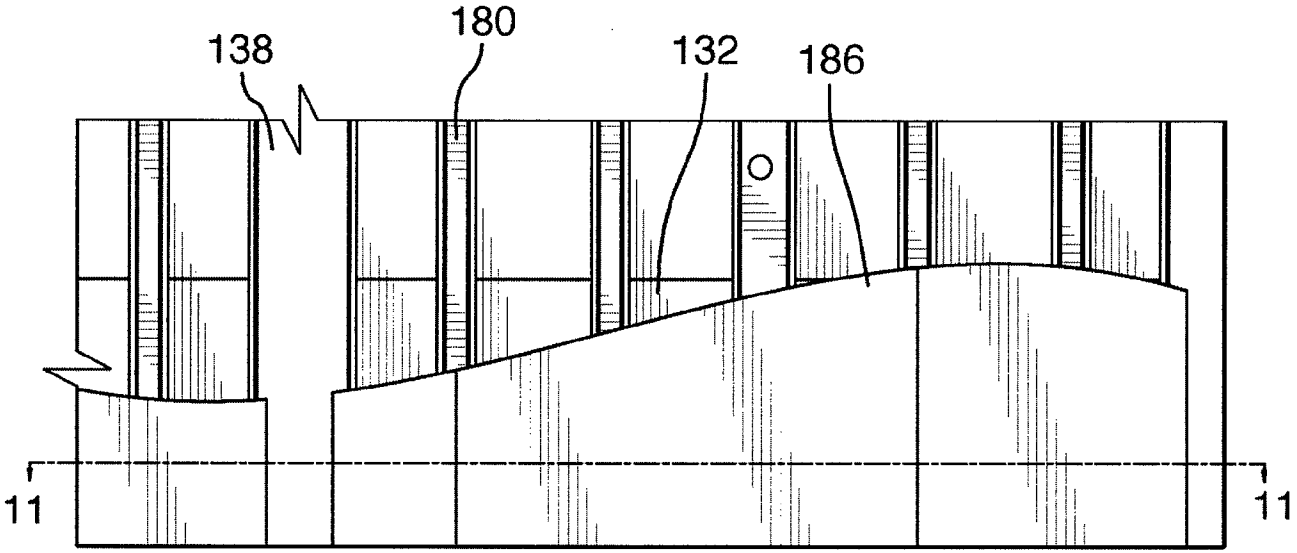
FIG. 10 shows a top detail taken from Detail 10 of FIG. 2.
Figure 11:
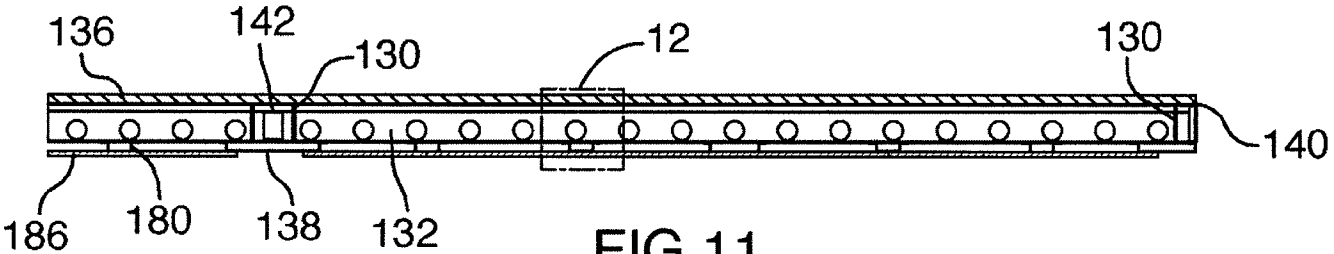
FIG. 11 shows a section view taken along section 11-11 of FIG. 10.
Figure 12:
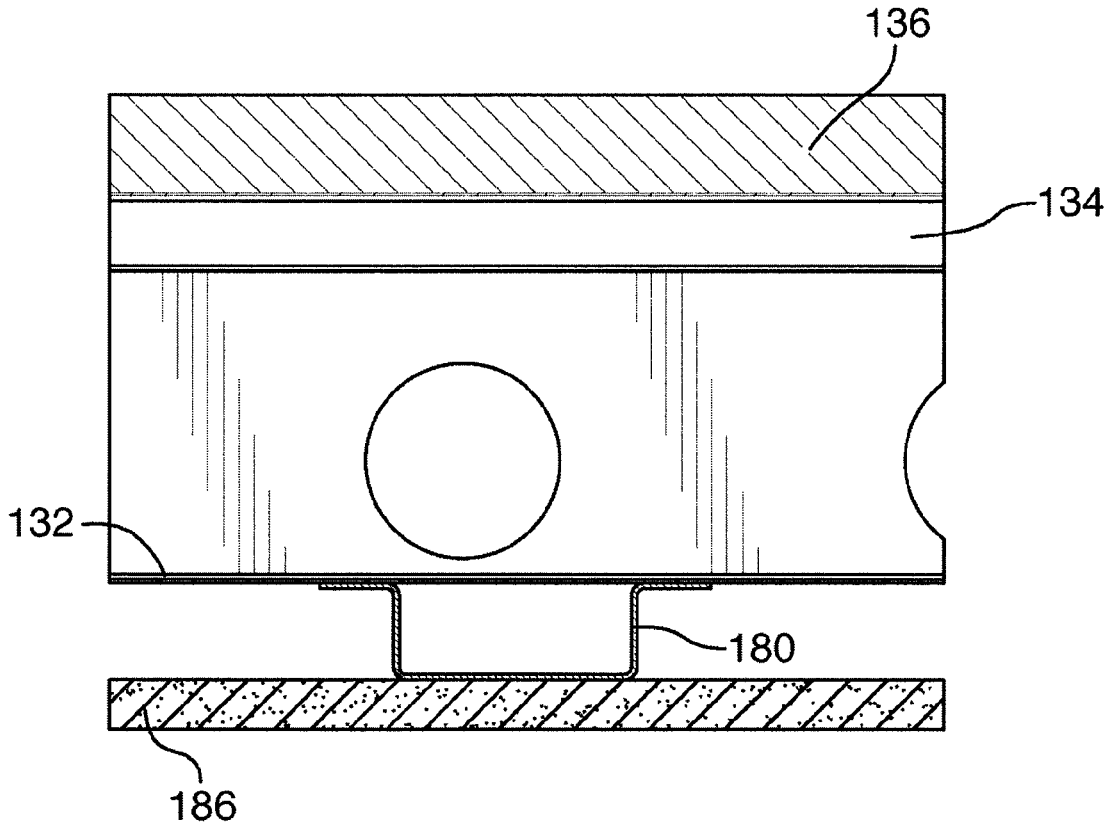
FIG. 12 shows a detail view taken from Detail 12 of FIG. 11.

Reference is now made to FIGS. 5A, 5B, and 6 to 9, which show in detail the modular building panel 104. As shown in FIG. 5A, the modular building panel 104 includes a panel frame 106 which is dimensioned to define axes for a longitudinal 108, a transverse width 110, and a transverse height 112. Referring now to FIG. 6, the panel frame 106 itself defines or at least partially defines a first duct 120 and second duct 122. The building panel 104 also includes one or more utility brackets 124 for insertion of building utility services such as plumbing, sprinklers, alarms, electrical, speakers, phone and data lines, and lighting within the ceiling. The building panel 104 also includes or at least partially defines one or more light boxes 126 for receiving of a light fixture, for example fluorescent light tube 150. It can be appreciated that each of the various components of the building panel 104 may include support structures in accordance with example embodiments.

As best shown in FIG. 5B, the panel frame 106 may be formed at least from a duct lower half 132, a duct upper half 134, a wide hat joist 138 which spans an end-to-end of the transverse width 110, and the light boxes 126. In some example embodiments, the panel frame 106 may include a rigid insulation 136. In another example embodiment, referring to FIG. 5A, the panel frame 106 may further include a ceiling end cap 140.

As shown in FIG. 5B, the ducts 120, 122 define a plenum or passage extending along the longitudinal 108 for passage of air, ventilation, and the like. As shown, each of the ducts 120, 122 are formed from the duct bottom half 132 and the duct upper half 134. These halves 132, 134 may be fastened together using splice plates 142, 144, as shown. The ducts 120, 122 may span an end-to-end of the transverse height 112. As can be appreciated, first duct 120 may be used for intake while second duct 122 may be used for output, or vice-versa. Each modular building panel 104 can be attached to a like modular building panel to extend the plenum or passage.

One or more duct stiffeners 130 are contained within the ducts 120, 122 for providing structural support. As shown, the duct stiffeners 130 are truss or zig-zag shaped and extend along the transverse width 110 and the transverse height 112 within the ducts 120, 122. The duct stiffeners 130 may for example be formed of a wire-shaped member to provide the required support without significantly impeding airflow.

Referring still to FIG. 5B, the building panel 104 includes one or more joists which span along the transverse width 110 to provide reinforcement at and between the ducts 120, 122, as well as spanning an end-to-end of the transverse width 110 of the building panel 104. Accordingly, in example embodiments the system 100 may not rely primarily on the truss or zig-zag shaped duct stiffeners 130 to provide reinforcement. The joists may be used to redistribute load from the ducts 120, 122 to other structures. In example embodiments, at least some of the joists are ribbed joists. In example embodiments, at least some of the ribbed joists are hat joists. Hat joists include joists having a hat-shaped cross-section, for example having a first plate, a second plate perpendicular to the first plate, a third plate perpendicular to the second plate, a fourth plate perpendicular to the third plate and opposing the second plate, and a fifth plate perpendicular to the fourth plate.

Referring still to FIG. 6, the utility bracket 124 spans from the first duct 120 to the second duct 122 along the transverse width 110. As shown the utility bracket 124 defines apertures 146, each for receiving a utility service lead. Example utility service leads include plumbing, electrical, phone and data lines. As shown, the apertures 146 may for example be rectangular or circular, or other suitable cross-sectional shapes. Referring again to FIG. 5*a*, the ceiling end cap 140 may also define such apertures. Referring to FIG. 6, it can be appreciated that utility bracket 124 can itself be used as a joist or joist stiffener.

Figure 13:
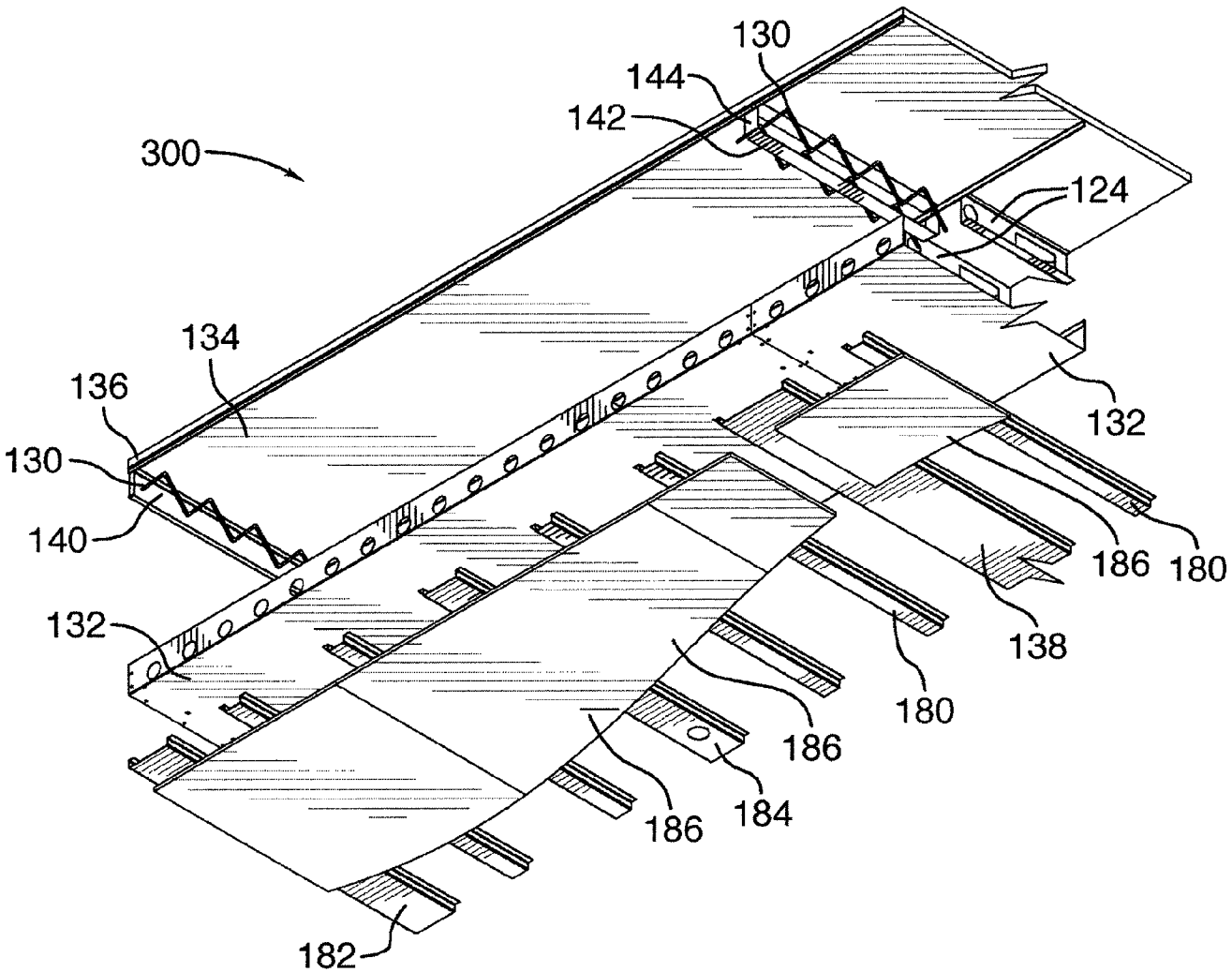
FIGS. 13 to 16 show a ceiling assembly including the system of FIG. 1 in accordance with an example embodiment.
Figure 14:
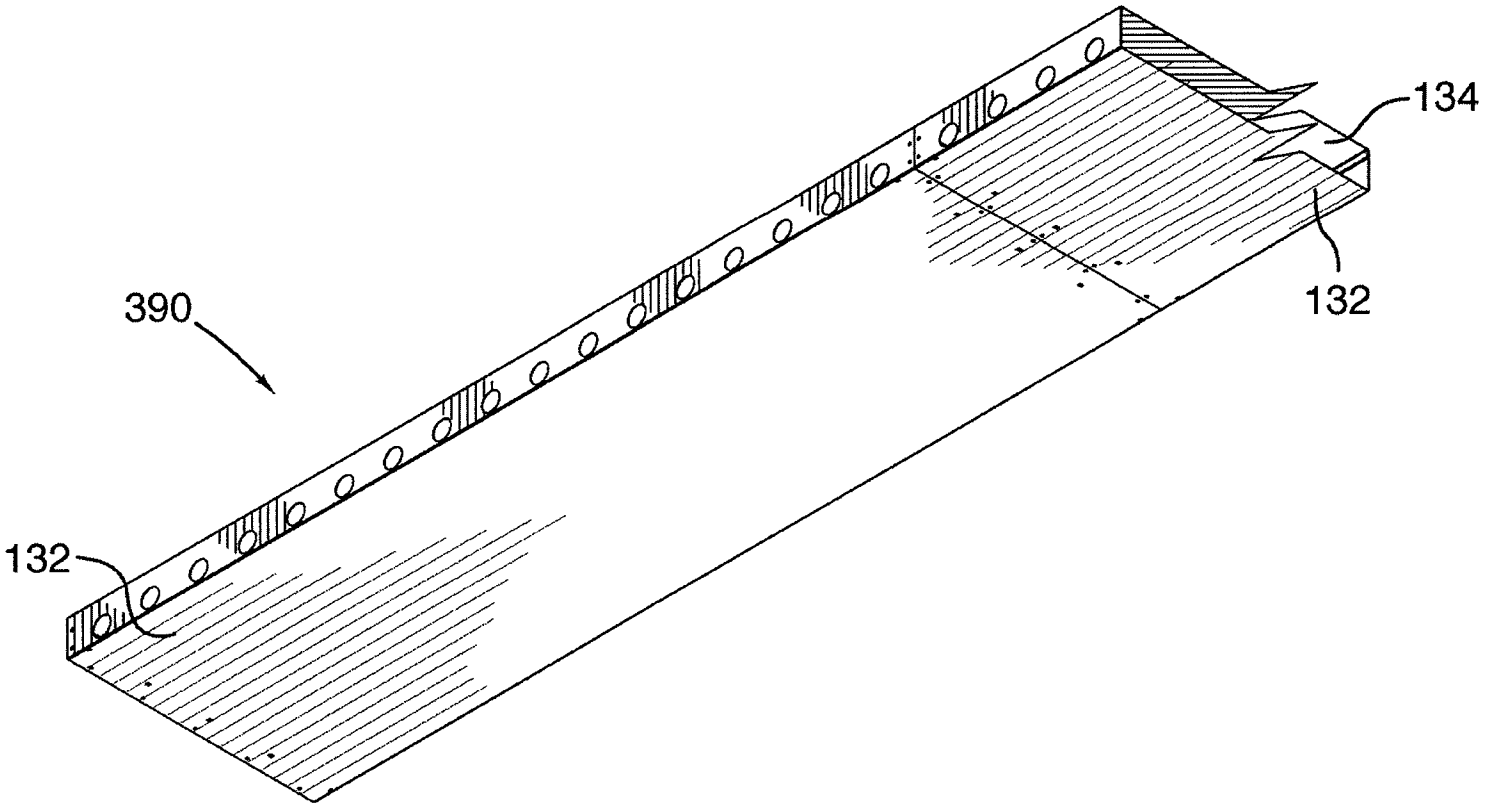
Figure 15:
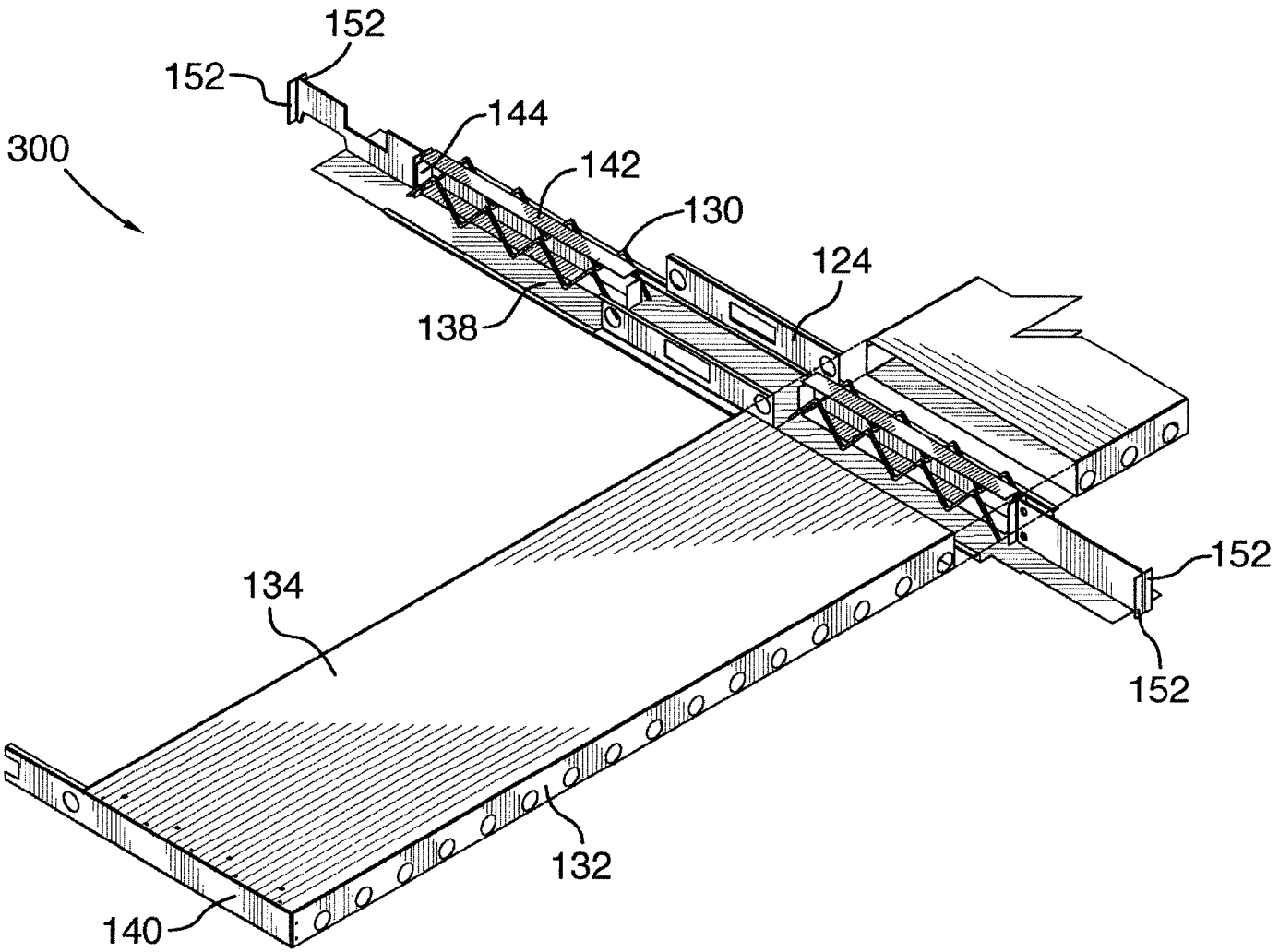
Figure 16:
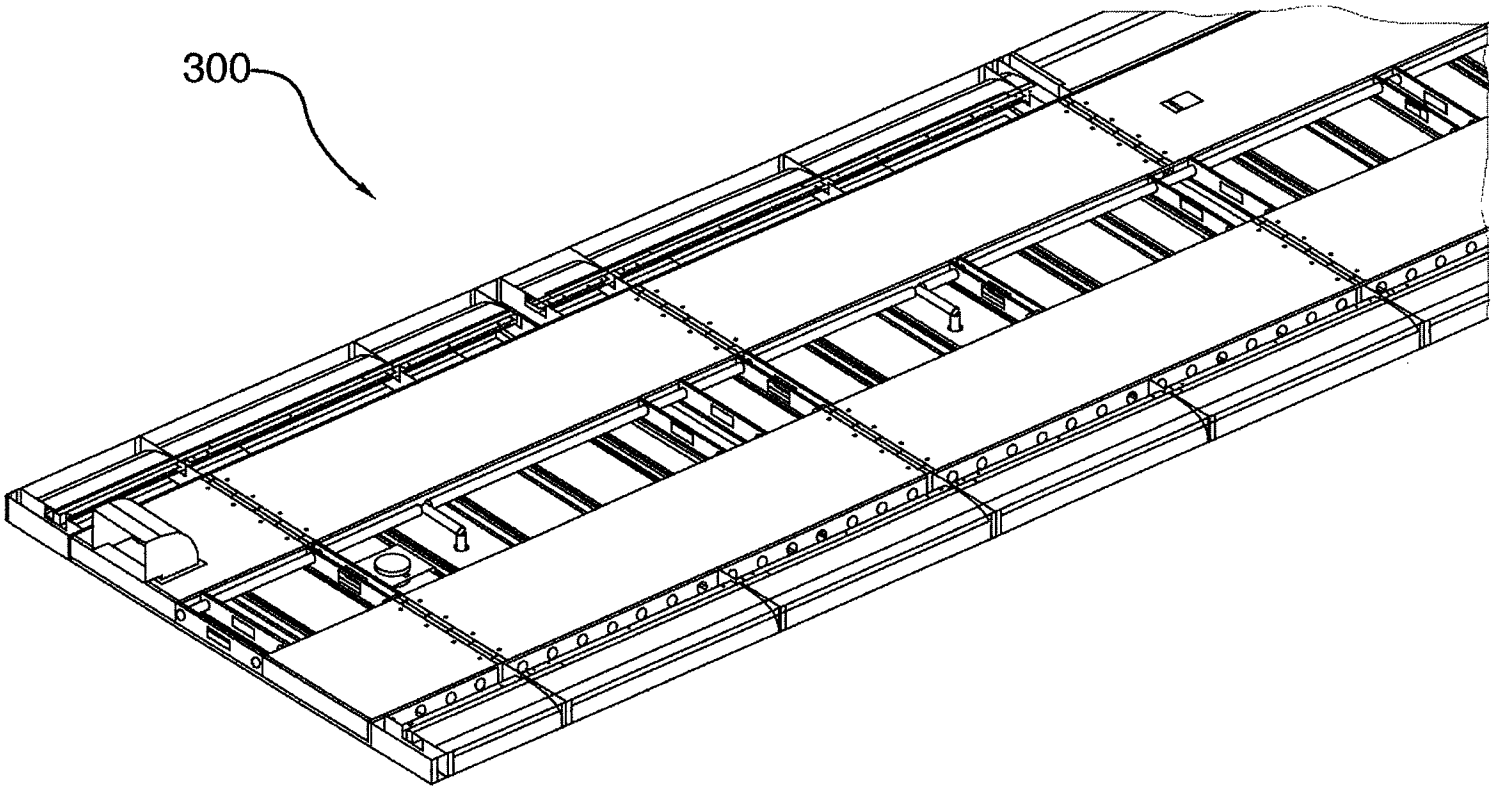

Reference is now made to FIGS. 13 to 16, which show a ceiling assembly 300 including the system 100 in accordance with an example embodiment. The ceiling assembly 300 illustrates additional joists in accordance with example embodiments. As shown in FIG. 13, the building panel 104 further includes a hat joist 180, an end hat joist 182, and a ceiling hat joist 184. These joists extend along the transverse width 110 (FIG. 5A). The joists assist in redistribution load from the ducts 120, 122 to, for example, each end of the panel 104. The various joists shown also provide a frame for attachment of a wall board, for example gypsum wall board 186, as shown.

It can be appreciated that the ceiling assembly 300 uses the system 100 which includes various ducts, voids and light coves that can convey and control the distribution of air, lighting and services. The ceiling assembly 300 carries loads applied perpendicularly to the panel face to the ribbed joists in the same plane, which load can be generated by gravity acting on the ceiling, or the load of structures above, depending on the orientation of the panel. The load can be distributed from the ducts 120, 122 to, for example, sidewalls.

In another example embodiment, during assembly the ceiling assembly 300 is laid as the (then) top story or floor, and concrete is poured onto the ceiling assembly 300 to construct the deck for the next story or floor.

Referring again to FIG. 5B, it can be appreciated that, the amount, number or frequency of the truss or zig-zag shaped duct stiffeners 130 may be lower than that of conventional wall or ceiling studs owing to the transverse load carrying capacity of the joists. Accordingly, the amount of material or total parts forming the duct stiffeners 130 may be reduced. It can be appreciated that this further reduces the degree of obstruction of the ducts 120, 122. It can further be appreciated that the ducts 120, 122 have a generally large and generally uninterrupted cross section suitable for conveying low-velocity forced air as commonly used in a commercial building.

Figure 17:
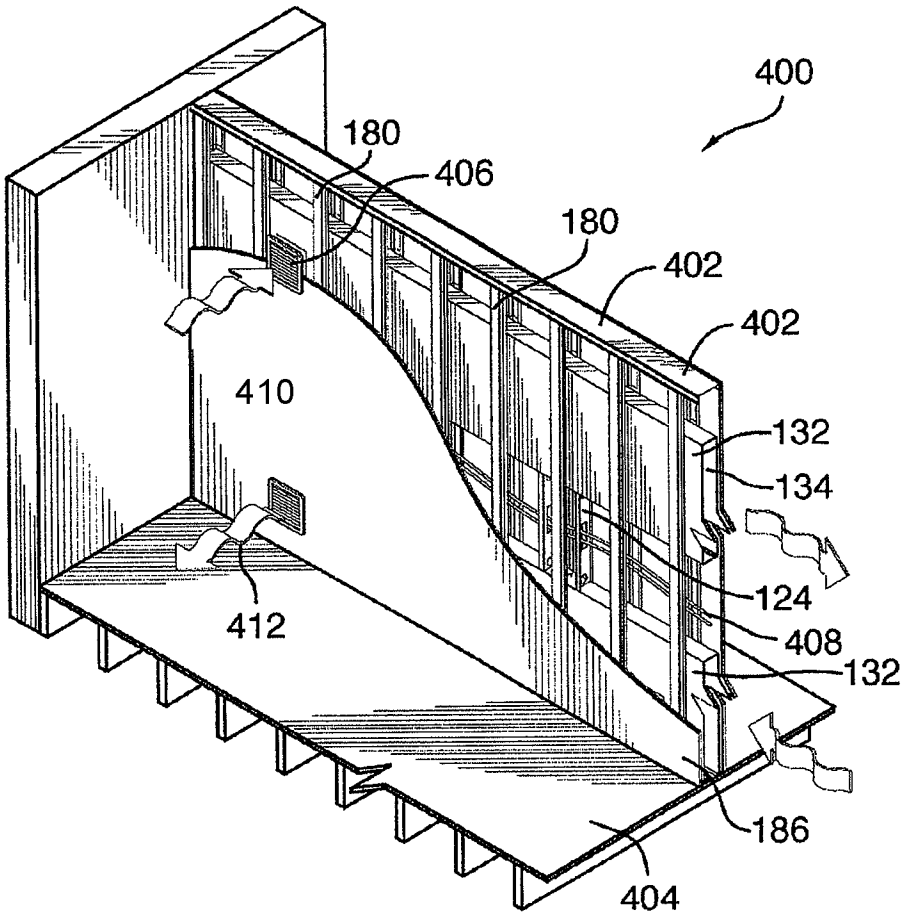
FIG. 17 shows a sidewall assembly including the system of FIG. 1 in accordance with another example embodiment.

Reference is now made to FIG. 17, which shows a sidewall assembly 400 including the system 100 in accordance with another example embodiment. The sidewall assembly 400 further includes a wall stud track 402, flooring 404, vent caps 406 or grills, and electrical wires 408 running through the utility bracket 124. Intake airflow is indicated by reference 410 while output airflow is indicated by reference 412.

It can be appreciated that, due to the high rigidity of the modular building panels 104, the panels 104 may be dimensioned to be larger than conventional ceiling assemblies and can be drywalled, seamed and painted, wired, handled and rotated in one piece. In example embodiments, the transverse width 110 of said panel 104 is dimensioned to a length (for ceiling assembly 300) or height (for sidewall assembly 400) of a building structure.

The light box 126 will now be described in greater detail, referring again to FIG. 5B. In addition to the fluorescent light tubes 150, there is provided light box stiffeners 152 which include plates which extend along the transverse width 110 and the transverse height 112. The plates of the light box stiffeners 152 may be arranged in a C-configuration, as shown. Light grills 154 are also provided which provide for redirection and/or diffusion of light, and may include aesthetic features. A curved light reflector 156 reflects light towards the light grills 154.

It can be appreciated that the lighting and light box 126 may be relatively hidden yet accessible for maintenance. Further, the light reflector 156 and light grills 154 can diffuse and control the beam spread so as to direct lighting onto the walls and light of the constructed room per recent architectural fashion.

In some example embodiments, the above-described parts may be assembled into subassemblies whose maximum size is limited by the capacity of forming machines. Said subassemblies can be assembled in to larger panels of the desired size owing to interlocking termination features, thereby reducing design and fabrication costs.

In some example embodiments, the panel may be dimensioned to be about two and a half feet in height, or less. In some example embodiments, the panel made from sets of parts which comprise a thin, light, exterior or interior grade, self-supporting unitized structural panel. The panel can be used for making exterior roofs, exterior or interior walls and ceilings, which can be hoisted and placed on a pre-fabricated building module as a unit, and to which can be added insulation, lighting, drywall, sprinklers, smoke detectors, loudspeakers, plumbing for washrooms, etc. as required.

It can be appreciated that, because modular building units are typically introduced into building openings and moved across floors to reach their destination, thinness of the ceiling is another factor, as it allows a complete modular building unit to be shipped and placed, without reducing interior ceiling height or requiring excessive overhead clearance. This is a feature which may be used for high-rise offices, condominiums or hotels where increased floor-to-floor height adds to overall building height and cost.

It can be appreciated that the ducts 120, 122 are configured so air can be introduced and released at any point, reducing design costs and facilitating fine-tuning of airflow. Airflow can be tuned by selectively creating or covering openings, or by the addition of adjustable diffusers or registers.

It can be appreciated that the ducts 120, 122 can be equipped with removable ends disposed so as to be exposed, facilitating cleaning by the introduction of a telescopic brush or vacuum nozzle.

In accordance with an example embodiment, there is provided a method of reinforcing a duct for use as part of a building panel, the building panel including a panel frame defining a longitudinal, a transverse width, and a transverse height, the duct being at least partly defined by the panel frame and defining a first passage extending along the longitudinal of the panel frame. The method includes positioning a duct stiffener within the duct, the duct stiffener being truss or zig-zag shaped and extending along the transverse width and the transverse height, and extending a ribbed joist from the duct to redistribute loads from the duct, wherein the ribbed joist spans an end-to-end of the transverse width of the panel frame.

The method includes preparing the constituent parts of a sheet metal duct so as to trap the duct stiffener when said duct is assembled, and subsequently fasten such truss creating a duct with enhanced resistance to shear, lateral tension and compression loads applied to the faces and edges of the duct. The ribbed joist may include hat joists which enhance this property and transmit loads to other structures in line with the duct stiffener. The method includes fastening wall finishes to either side through the addition of a complimentary continuous transverse structural member.

It can be appreciated that various aspects or components have been described as systems but may be similarly implemented as methods, and vice-versa.

Variations may be made to some example embodiments, which may include combinations and sub-combinations of any of the above. The various embodiments presented above are merely examples and are in no way meant to limit the scope of this disclosure. Variations of the innovations described herein will be apparent to persons of ordinary skill in the art, such variations being within the intended scope of the present disclosure. In particular, features from one or more of the above-described embodiments may be selected to create alternative embodiments comprised of a sub-combination of features which may not be explicitly described above. In addition, features from one or more of the above-described embodiments may be selected and combined to create alternative embodiments comprised of a combination of features which may not be explicitly described above. Features suitable for such combinations and sub-combinations would be readily apparent to persons skilled in the art upon review of the present disclosure as a whole. The subject matter described herein intends to cover and embrace all suitable changes in technology.

What is claimed is:

1. A modular building panel, comprising:

a panel frame defining a longitudinal length, a transverse width, and a transverse height;

a first duct at least partly defined by the panel frame and defining a first passage extending along the longitudinal length of the panel frame and positioned along the transverse width;

a first duct stiffener contained within the first duct for providing structural support, the first duct stiffener being truss or zig-zag shaped and extending along the transverse width and the transverse height;

a second duct at least partly defined by the panel frame and defining a second passage extending along the longitudinal length of the panel frame and positioned along the transverse width separate from the first duct;

a second duct stiffener contained within the second duct for providing structural support, the second duct stiffener being truss or zig-zag shaped and extending along the transverse width and the transverse height; and a wall of the first duct and the second duct comprising a ribbed joist spanning between the first duct and the second duct along the transverse width.

2. The modular building panel as claimed in claim 1, further comprising a utility bracket spanning at least a portion of the transverse width, the utility bracket defining at least one aperture for receiving a utility service lead.

3. The modular building panel as claimed in claim 2, wherein the utility bracket spans between the first duct and second duct.

4. The modular building panel as claimed in claim 2, wherein the ribbed joist includes the utility bracket.

5. The modular building panel as claimed in claim 1, further comprising a light box positioned along the transverse width at least partly defined by the panel frame, the light box including a light box frame for receiving of a light fixture, the light box further including a light box stiffener extending along the transverse width and the transverse height.

6. The modular building panel as claimed in claim 5, wherein the light box stiffener is in a C-configuration.

7. The modular building panel as claimed in claim 1, wherein said ribbed joist spans an end-to-end of the transverse width of the panel frame.

8. The modular building panel as claimed in claim 1, wherein said ribbed joist includes a first plate, a second plate perpendicular to the first plate, a third plate perpendicular to the second plate, a fourth plate perpendicular to the third plate and opposing the second plate, and a fifth plate perpendicular to the fourth plate.

9. The modular building panel as claimed in claim 1, wherein said ribbed joist provides a frame for attachment of a wall board.

10. The modular building panel as claimed in claim 1, wherein said duct stiffener is formed of a wire-shaped member.

11. The modular building panel as claimed in claim 1, wherein the first duct or second duct spans an end-to-end of the transverse height.

12. The modular building panel as claimed in claim 1, wherein said modular building panel is connectable to a like modular building panel along the longitudinal to extend the first passage and the second passage.

13. The modular building panel as claimed in claim 1, wherein said transverse width of said panel frame is dimensioned to a length or height of a building structure.

14. The modular building panel of claim 1, wherein the ribbed joist is a hat joist.

15. A modular building panel and integrated duct system, comprising:

a plurality of like modular building panels, each panel including:

a panel frame defining a longitudinal length, a transverse width, and a transverse height, a first duct at least partly defined by the panel frame and defining a first passage extending along the longitudinal length of the panel frame and positioned along the transverse width, a first duct stiffener contained within the first duct for providing structural support, the first duct stiffener being truss or zig-zag shaped and extending along the transverse width and the transverse height, a second duct at least partly defined by the panel frame and defining a second passage extending along the longitudinal length of the panel frame and positioned along the transverse width separate from the first duct, a second duct stiffener contained within the second duct for providing structural support, the second duct stiffener being truss or zig-zag shaped and extending along the transverse width and the transverse height, and a wall of the first duct and the second duct comprising a ribbed joist spanning between the first duct and the second duct along the transverse width.

* * * * *